US008973273B2

(12) United States Patent
Brown et al.

(10) Patent No.: US 8,973,273 B2
(45) Date of Patent: Mar. 10, 2015

(54) FOLDABLE CHISEL

(75) Inventors: Joshua Brown, New Haven, CT (US); Keith M. Lombardi, Avon, CT (US); Vincent Cook, Milford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 344 days.

(21) Appl. No.: 13/350,465

(22) Filed: Jan. 13, 2012

(65) Prior Publication Data

US 2013/0180114 A1 Jul. 18, 2013

(51) Int. Cl.
*B25D 3/00* (2006.01)

(52) U.S. Cl.
USPC ..... 30/167; 30/153; 30/155

(58) Field of Classification Search
CPC ..... B25D 3/00; B25G 3/00; B25G 3/38
USPC ..... 30/153, 155, 164.5, 167, 167.1, 167.2, 30/340, 342, 344; D22/118; D8/47, 99, D8/107; 81/427.5, 177.6, 332; 7/118, 7/127–129
See application file for complete search history.

(56) References Cited

U.S. PATENT DOCUMENTS

| | | | | |
|---|---|---|---|---|
| 229,706 | A * | 7/1880 | Jansen | 30/153 |
| 237,498 | A * | 2/1881 | Deasey | 30/153 |
| 365,086 | A | 6/1887 | Miller | |
| 447,185 | A * | 2/1891 | Hollweg | 30/153 |
| 508,273 | A * | 11/1893 | Brauch | 30/153 |
| 847,206 | A * | 3/1907 | Saunderson | 30/153 |
| 881,294 | A * | 3/1908 | Billings | 30/153 |
| 952,744 | A | 3/1910 | Johnson | |
| 1,203,840 | A | 11/1916 | Bailey | |
| 1,549,545 | A * | 8/1925 | Hickman | 30/153 |
| 1,659,418 | A * | 2/1928 | Werner | 30/153 |
| 1,665,955 | A | 4/1928 | Gatewood | |

(Continued)

FOREIGN PATENT DOCUMENTS

| | | | |
|---|---|---|---|
| AU | 2013200102 | A1 * | 8/2013 |
| BE | 482885 | | 12/1948 |

(Continued)

OTHER PUBLICATIONS

Kitchen, D. Pocket Chisel [online], Toolmonger, Apr. 25, 2008 [retrieved on Oct. 21, 2013]. Retrieved from the Internet <URL:http://toolmonger.com/2008/04/25/pocket-chisel/>.

(Continued)

*Primary Examiner* — Jason Daniel Prone
(74) *Attorney, Agent, or Firm* — Pillsbury Winthrop Shaw Pittman LLP

(57) ABSTRACT

A chisel includes a blade and a first handle and second handle that are each rotatably coupled to the blade. The first handle forms a first channel adapted to receive a first side of the blade and the second handle forms a second channel adapted to receive a second side of the blade opposite the first side. The two handles are rotatable between an open and a closed position. In some cases, the two handles comprise a rotatable coupling such that the first handle and the second handle rotate with one another in opposite directions between the closed and open positions. The chisel further can have an over-center structure configured to impede rotation of the two handles from the closed toward the open position. In some cases, the two handles each form an interlocking component adapted to releasably couple the two handles when they are rotated to the open position.

19 Claims, 5 Drawing Sheets

(56) References Cited

U.S. PATENT DOCUMENTS

| | | | | | |
|---|---|---|---|---|---|
| D154,482 | S | * | 7/1949 | Hill | D22/118 |
| 2,475,041 | A | | 7/1949 | Mattson | |
| 2,714,249 | A | * | 8/1955 | Clark et al. | 30/153 |
| 2,735,179 | A | | 2/1956 | Stanton | |
| 2,823,561 | A | | 2/1958 | Opocensky | |
| 4,047,298 | A | | 9/1977 | Philippar | |
| 4,330,937 | A | * | 5/1982 | Cope | 30/153 |
| 4,364,174 | A | * | 12/1982 | De Asis | 30/153 |
| 4,507,863 | A | * | 4/1985 | Rowe | 30/144 |
| D280,179 | S | * | 8/1985 | Miceli | D8/99 |
| 4,547,965 | A | | 10/1985 | Moore | |
| 4,555,822 | A | * | 12/1985 | Miceli | 30/153 |
| 4,586,496 | A | | 5/1986 | Keller | |
| 4,648,145 | A | | 3/1987 | Miceli | |
| D289,368 | S | * | 4/1987 | Mann | D8/99 |
| 4,669,140 | A | | 6/1987 | Miceli | |
| 4,672,743 | A | | 6/1987 | Grahm | |
| 4,722,140 | A | * | 2/1988 | Miceli | 30/153 |
| 5,809,599 | A | | 9/1998 | Frazer | |
| 5,953,820 | A | | 9/1999 | Vasudeva | |
| D420,883 | S | * | 2/2000 | Zaha | D8/99 |
| D420,884 | S | * | 2/2000 | Zaha | D8/99 |
| D422,190 | S | * | 4/2000 | Zaha | D8/99 |
| D424,398 | S | * | 5/2000 | Zaha | D8/99 |
| D429,615 | S | * | 8/2000 | Zaha | D8/99 |
| 6,170,158 | B1 | * | 1/2001 | Daily | 30/342 |
| 6,195,898 | B1 | * | 3/2001 | Lemisch | 30/153 |
| 6,550,142 | B1 | | 4/2003 | Moser | |
| D487,494 | S | * | 3/2004 | Glesser | D22/118 |
| 6,715,208 | B2 | | 4/2004 | Lemisch | |
| 6,848,183 | B2 | * | 2/2005 | Lemisch | 30/153 |
| D566,222 | S | * | 4/2008 | Hawk et al. | D22/118 |
| 7,533,465 | B1 | | 5/2009 | Frazer | |
| D596,472 | S | * | 7/2009 | Cook | D8/47 |
| 7,634,858 | B1 | | 12/2009 | Frazer | |
| 7,676,930 | B1 | * | 3/2010 | Demko | 30/153 |
| D710,166 | S | * | 8/2014 | Cook | D8/47 |
| 2001/0005941 | A1 | * | 7/2001 | DiMatteo et al. | 30/194 |
| 2004/0025354 | A1 | | 2/2004 | Lemisch | |
| 2004/0181946 | A1 | | 9/2004 | Lemisch | |
| 2005/0132577 | A1 | | 6/2005 | Henriksen | |
| 2005/0284909 | A1 | | 12/2005 | Munoz | |
| 2006/0196056 | A1 | | 9/2006 | Davis | |
| 2008/0236210 | A1 | * | 10/2008 | Frazer | 7/128 |
| 2009/0142127 | A1 | * | 6/2009 | Glesser et al. | 7/118 |
| 2010/0139101 | A1 | | 6/2010 | Cooper | |

FOREIGN PATENT DOCUMENTS

| | | | | |
|---|---|---|---|---|
| CA | 2802248 | A1 | * | 7/2013 |
| CH | 684635 | | | 11/1994 |
| CN | 201195333 | | | 2/2009 |
| EP | 2614929 | A1 | * | 7/2013 |
| FR | 2 554 036 | | | 5/1985 |
| GB | 606631 | | | 8/1948 |
| GB | 2433911 | A | * | 7/2007 |
| WO | WO 9955498 | A1 | * | 11/1999 |
| WO | WO 03/051584 | | | 6/2003 |
| WO | WO 2008001138 | A1 | * | 1/2008 |

OTHER PUBLICATIONS

2009 FastCap Innovative products for the serious woodworker. Pocket Chisel [online]. FastCap, 2009 [retrieved on Oct. 21, 2013]. Retrieved from the Internet: <URL: http://www.fastcap.com/doc/CAT08_web.pdf>.

Extended Search Report, including the Search Opinion, as issued for European Patent Application No. 13150745.1, dated Apr. 15, 2013.

Pocket Chisel. [online] FastCap, 2011 [retrieved on Jan. 12, 2012]. Retrieved from the Internet <URL: http://www.fastcap.com/estore/pc/Pocket-Chisel-3p2470.htm>.

* cited by examiner

FOLDABLE CHISEL

BACKGROUND

1. Field

The present invention is generally related to chisels. More particularly, the application relates to foldable chisels.

2. Description of Related Art

Chisels typically include a blade with a cutting edge and one or more handles. The one or more handles are adapted for carrying the chisel and for being struck by another tool, such as a hammer, to drive the cutting edge to carve, shave, or cut a work piece. When the chisel is being transported, it may be carried in a bag to protect the blade against damage and to protect users from the cutting edge of the blade.

SUMMARY

One embodiment comprises a chisel having: a blade; a first handle rotatably coupled to the blade and forming a first channel adapted to receive a first side of the blade; and a a second handle rotatably coupled to the blade and forming a second channel adapted to receive a second side of the blade opposite the first side of the blade. The first handle and second handle are rotatable between an open position in which the blade is substantially exposed and a closed position in which the blade is at least partially contained in the first channel and the second channel. The first handle and the second handle comprise a rotatable coupling such that the first handle and the second handle rotate with one another in opposite directions between the closed position and the open position. The foldable chisel further comprises an over-center structure configured to impede rotation of the first handle and the second handle from the closed position toward the open position.

One embodiment comprises a chisel having a blade; a first handle rotatably coupled to the blade; and a second handle rotatably coupled to the blade. The first handle comprises a first interlocking component and forms a first channel adapted to receive a first side of the blade. The second handle comprises a second interlocking component and forms a second channel adapted to receive a second side of the blade opposite the first side of the blade. The first handle and the second handle are rotatable between an open position in which the blade is substantially exposed and a closed position in which the blade is at least partially contained in the first channel and the second channel. The first interlocking component and the second interlocking component are adapted to releasably couple the first handle and the second handle when the two handles are rotated to the open position.

Aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein can be considered drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION

Figure 1A:
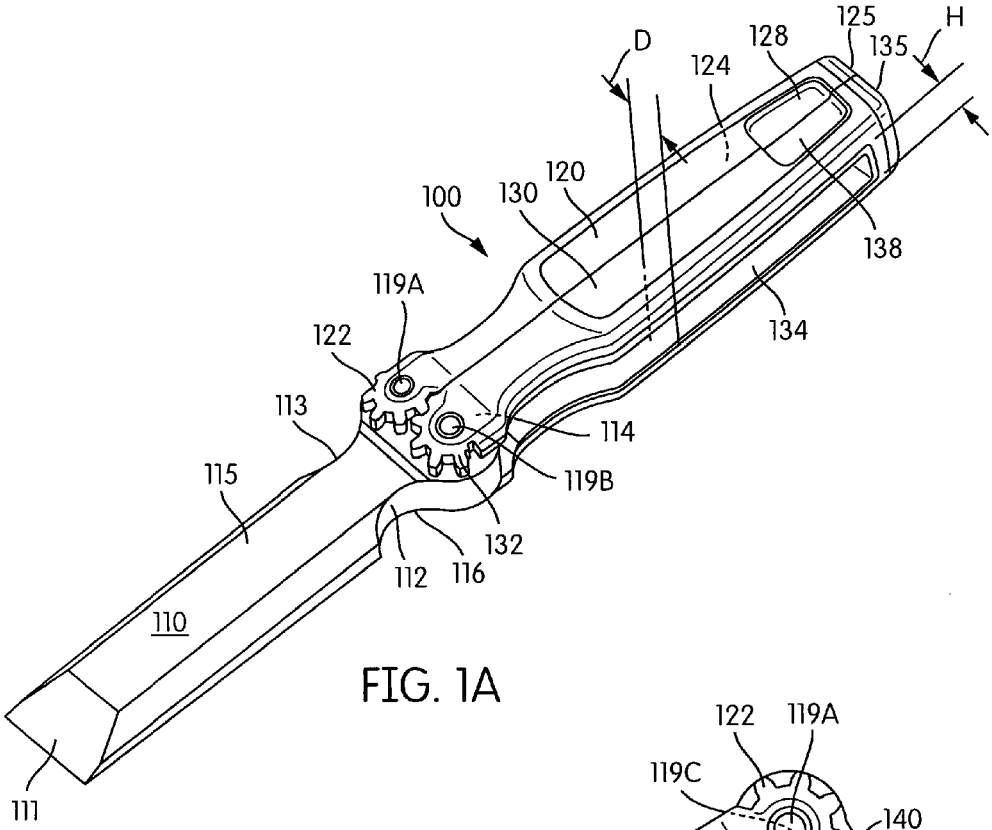
FIG. 1A shows a perspective view of a foldable chisel in an open position.
Figure 1B:
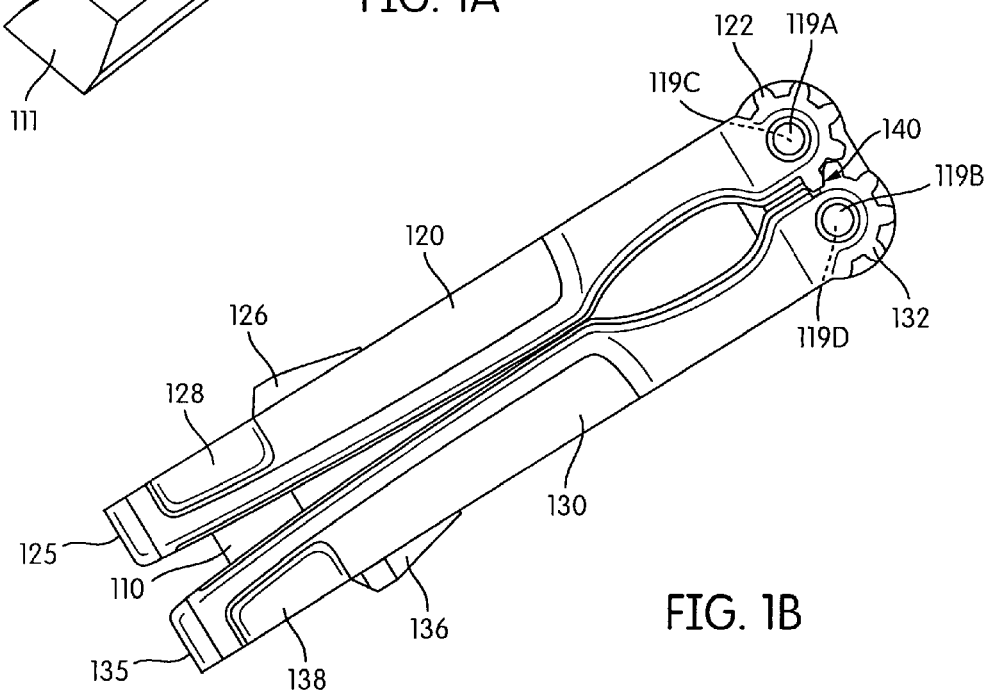
FIG. 1B shows a perspective view of the foldable chisel of FIG. 1A in a closed position.

Referring now more particularly to the drawings, FIGS. 1A and 1B are perspective views of a foldable chisel 100 in accordance with one embodiment of the invention. FIG. 1A shows foldable chisel 100 in an open, or unfolded position, while FIG. 1B shows foldable chisel 100 in a closed, or folded position. Chisel 100 includes an elongated blade 110 and handles 120 and 130 that are both coupled to blade 110.

Blade 110 may have one or more cutting edges adapted to, for example, carve, shave, or cut work pieces. As shown in FIG. 1A, blade 110 may have a beveled front cutting edge 111, a chamfered left side 112 and chamfered right side 113, and a back side 114. In some embodiments, blade 110 may have one or more cutting edges in addition to or other than front cutting edge 111, such as a cutting edge on left side 112 or right side 113 of the blade 110. The cutting edge may be beveled or non-beveled. In some embodiments, left side 112 or right side 113 may be directly adjacent to a top surface 115 or bottom surface 116 without a chamfer between the side and top or bottom surfaces. The left side 112 or right side 113 may be orthogonal to top surface 115 or bottom surface 116, as shown in FIG. 1A, or may be oblique to the top surface 115 or bottom surface. The left side 112 or right side 113 may be orthogonal to front edge 111 or back side 114, as shown in FIG. 1A, or may be oblique to the front edge 111 and back side 114. For example, blade 110 may be shaped as a trapezoid that widens from back side 114 towards front edge 111. In some embodiments, opposite sides of blade 110 may not be parallel. For example, relative to bottom surface 116, top surface 115 may slant toward front edge 111 or may slant toward left side 112 or right side 113 to form, for example, a cutting side edge.

Figure 2:
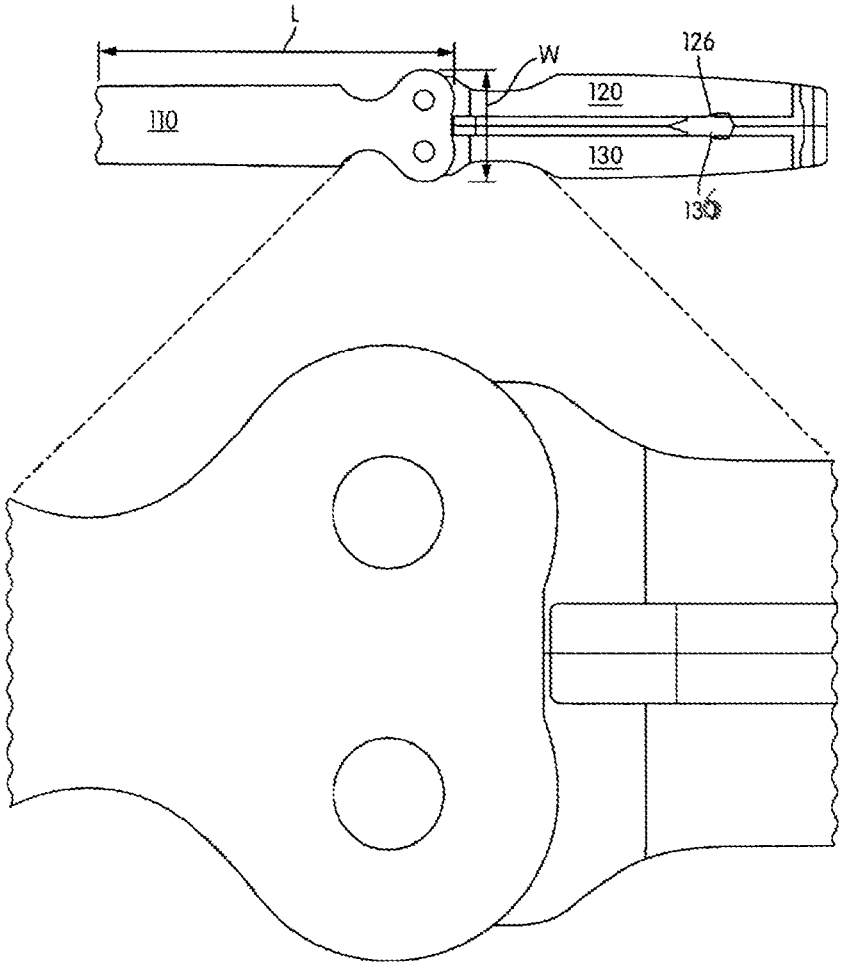
FIG. 2 shows a cross section view taken along a plane parallel to a top and bottom surface of the foldable chisel of FIG. 1A.

Blade 110 may have a width W that is constant along blade 110 or that varies along the blade 110. For example, as shown in FIG. 1A and FIG. 2, the width of blade 110 may narrow at a neck between a pair of concave-shaped recesses and may widen at both the front edge 111 and back side 114 of the blade. At the back side 114, blade 110 may widen on each side to form a circular contour that may match a contour of gears provided on chisel handles, which are discussed more below, coupled to blade 110. In another example, as discussed above, blade 110 may form a trapezoidal shape. In another example, the left side 112 and right side 113 may curve outward such that the blade 110 has a semi-circular or a semi-elliptical shape. In some embodiments, blade 110 may be substantially as wide as a total width of handles 120 and 130, while in other embodiments blade 110 may be substantially narrower or substantially wider.

Each of handles 120 and 130 (and particularly the rear ends 125, 135 thereof) may be configured for being struck by another tool or striking instrument, such as a hammer. In some embodiments, the rear of each handle may comprise an end cap that may be made of materials (e.g., steel) known to withstand impact from the striking instrument. Alternatively, each handle may be entirely formed from a material suitable for being struck. Each handle may be made of metal, wood, a composite material, or a synthetic material. Each handle may be contoured, shock absorbent, or ergonomic. For example, handles 120 and 130 may each have a recessed portion 128 and 138, respectively, adapted for gripping handles 120 and 130 when they are to be pivotally moved from the deployed position shown in FIG. 1A to the closed or storage position illustrated in FIG. 1B.

Figure 4:
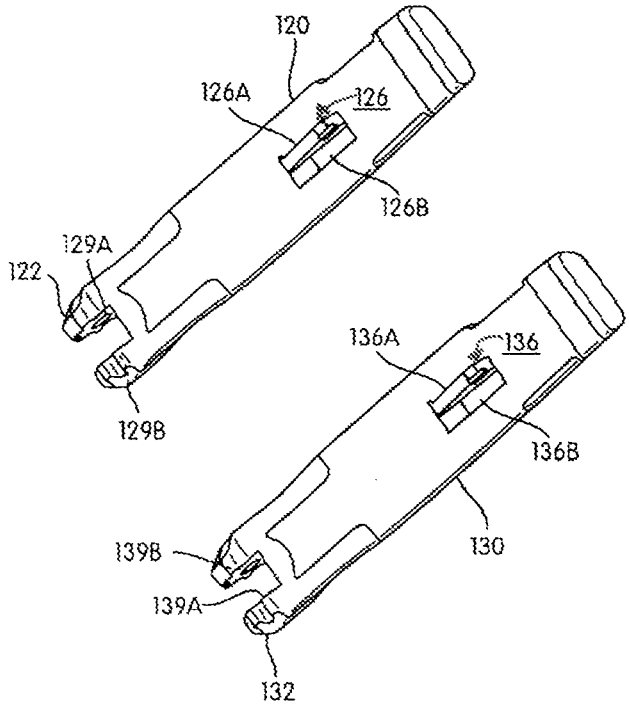
FIG. 4 shows an exploded perspective view of two handles of the foldable chisel of FIG. 1A.

Each of handles 120 and 130 may be coupled to blade 110 in a manner that allows each of the handles to rotate relative to the blade. The rotation allows the two handles to collapse around the blade, reducing the size of foldable chisel 100 and making storage and transport of the chisel 100 more convenient. In the example shown in FIG. 1A, each of handles 120 and 130 may form a hinge configuration with blade 110. Two pins 119A and 119B may protrude from top surface 115 and may each be fitted into a complementary slot 129A on handle 120 or a complementary slot 139A on handle 130, as seen in FIG. 1B and FIG. 4. Each pin 119A or 119B may form a pivot around which its respective handle may rotate. In another example, a pin may protrude from each of handles 120 and 130. Each pin may be fitted into a slot formed on blade 110. In some cases, the pin may form an axle that extends through the entire blade. In another example, each handle may be rotatably coupled to the blade 110 through a ball and socket configuration. Bearings, bushing, or lubrication, such as Teflon®, may be located at an interface between the handles 120, 130 and the blade 110 to reduce rotational friction. In some embodiments, each handle may be rotatably coupled to blade 110 at both top surface 115 and bottom surface 116. For example, handle 120 may comprise two slots 129A and 129B, as seen in FIG. 4. As seen in FIG. 1B and FIG. 4, slot 129A may fit around pin 119A on the top surface 115 of blade 110, while slot 129B may fit around pin 119C on bottom surface 116 of blade 110. In the example, handle 130 may comprise two slots 139A and 139B, as seen in FIG. 4. As seen in FIG. 1B and FIG. 4, slot 139A may fit around pin 119B on top surface 115 of blade 110, while slot 139B may fit around pin 119D on the bottom surface 116 of blade 110. In other embodiments, each handle may be rotatably coupled to blade 110 on only one side of the blade 110. For example, blade 110 and handles 120 and 130 may be rotatably coupled at top surface 115 of the blade 110, while bottom surface 116 may be flat and abutting an inner wall of handle 120 and an inner wall of handle 130.

Each of handles 120 and 130 may be rotatable between the open, or unfolded position illustrated in FIG. 1A and the closed, or folded position illustrated in FIG. 1B. The folded position is more compact for storage purposes. In some embodiments, as the handles 120 and 130 are rotated toward the closed position, channels 124 and 134 formed in the handles may receive sides of the blade. For example, channel 124 may receive right side 113 of blade 110 and channel 134 may receive left side 112 of blade 110. Each channel may have a length that is substantially the same, longer, or substantially longer than the length L of blade 110. The length of one of the channels 124, 134 may further be substantially the same, shorter, or substantially shorter than the handle on which it is formed.

Each channel may have a height H that is substantially the same, greater, or substantially greater than a thickness of blade 110. In some embodiments, the height H of the channel may be uniform, as shown in FIG. 1A, or may vary along the length of the handles. In one example, if blade 110 decreased in thickness from back side 114 toward front edge 111, each of channels 124 and 134 may decrease in height along the length of the handle, from a side of the handle near back side 114 toward opposite side 125 or 135 of the handle. The height decrease may have a first slope and a second, steeper slope. The second, steeper slope may follow a slope of the beveled surface near front edge 111 and the first, shallower slope may follow a slope of a surface of blade 110 between the beveled surface and back side 114. In some embodiments, the height H of the channel may vary along the width of the handles. In one example, if blade 110 has a beveled or chamfered side, as illustrated in FIG. 1A, the height H of each of channels 124 and 134 may be greatest at a mouth of the channel and may decrease along the width of its handle, forming a shape that substantially matches the chamfered or beveled shape of the left side 112 and right side 113 of the chisel.

Channels 124 and 134 each have a depth D that may together be sufficiently deep to contain at least a partial portion of blade 110. For example, each of channels 124 and 134 may have a depth D that is about half the width of blade 110. When the two handles are folded to the closed position, blade 110 may be substantially contained in a combination of channels 124 and 134. In another example, each of channels 124 and 134 may have a depth D that is substantially less than the width of blade 110 (e.g., one-third or one-quarter of the width of blade 110), such that only a partial portion of the blade 110 (e.g., two-thirds or one-half of blade 110) is contained in the combination of channels 124 and 134. In some embodiments, each channel may have a depth that varies along the length of its handle. For example, if blade 110 widened from back side 114 toward front edge 111, each channel 124, 134 may be shallowest near back side 114 and may deepen toward the opposite side 125, 135 of the handle. The slope of deepening may follow a slope at which blade 110 widens, or may be steeper or shallower. In some embodiments, each channel may have a depth that varies along a top-to-bottom direction of the handles. The depth may be varied, for example, to match the shape of the blade 110 of FIG. 1, which has a chamfered side. The channel may be shallowest near a top surface of the handles 120 and 130 and deepest near their bottom surface to accommodate the wider bottom surface 116 of blade 110. The same shape may be achieved by varying the height H of the channel, as discussed above.

In some embodiments, when handles 120 and 130 are rotated to the open position, channels 124 and 134 may be separated by a wall on a back side of handle 120 and a wall on a back side of handle 130. In some embodiments, the back sides of handles 120 and 130 may have no wall, or may have a wall with an opening, such that channels 124 and 134 form a contiguous cavity when the handles are rotated to the open position.

Handles 120 and 130 comprise a coupling that generates synchronized movement among the two handles. In one embodiment, handles 120 and 130 have a rotatable coupling that can take the form of two gears. For example, as shown in the figures, a gear 122 and a gear 132 are provided on handles 120 and 130, respectively. Gears 122 and 132 operatively engage and substantially synchronize rotation of the two handles. For example, gears 122 and 132 may force handles 120 and 130 to rotate in opposite directions at substantially the same rate. Each gear may be a separate component coupled to its handle or may be part of its handle's main body. Gears 122 and 132 may operatively engage each other through one or more gear teeth on each gear. For example, the gear teeth of gear 122 may mesh with the gear teeth of gear 132, as shown in FIG. 1A. In another example, the one or more gear teeth of gears 122 and 132 may mesh with one or more gear teeth of one or more intervening gears placed between gears 122 and 132. Each gear 122 and 132 may have five gear teeth, as shown in FIG. 1A, or may have one, three, six, seven, or any other number of gear teeth. Each gear may have a diameter substantially the same as the width of its handle, as shown in FIG. 1A, or may have a diameter that is substantially greater or less than the width of its handle. In some embodiments, while gears 122 and 132 may be in contact with blade 110, remaining portions of handles 120 and 130 may have a clearance (e.g., 0.5 mm) from a top 115 or bottom surface 116 of blade 110.

In some embodiments, such as one shown in FIG. 4, handles 120 and 130 may each comprise multiple gears. The gears may mesh at multiple surfaces of blade 110, such as top surface 115 and bottom surface 116. In some embodiments, each handle may comprise only one gear. The gears, such as gears 122 and 132, comprise one embodiment of the rotatable coupling of handles 120 and 130. In some embodiments, rotatable coupling 120 and 130 can also be a different type of rotatable coupling, such as a four-bar linkage, pivotal coupling, or other type of coupling that generates synchronized movement of the handles 120, 130.

Figure 3:
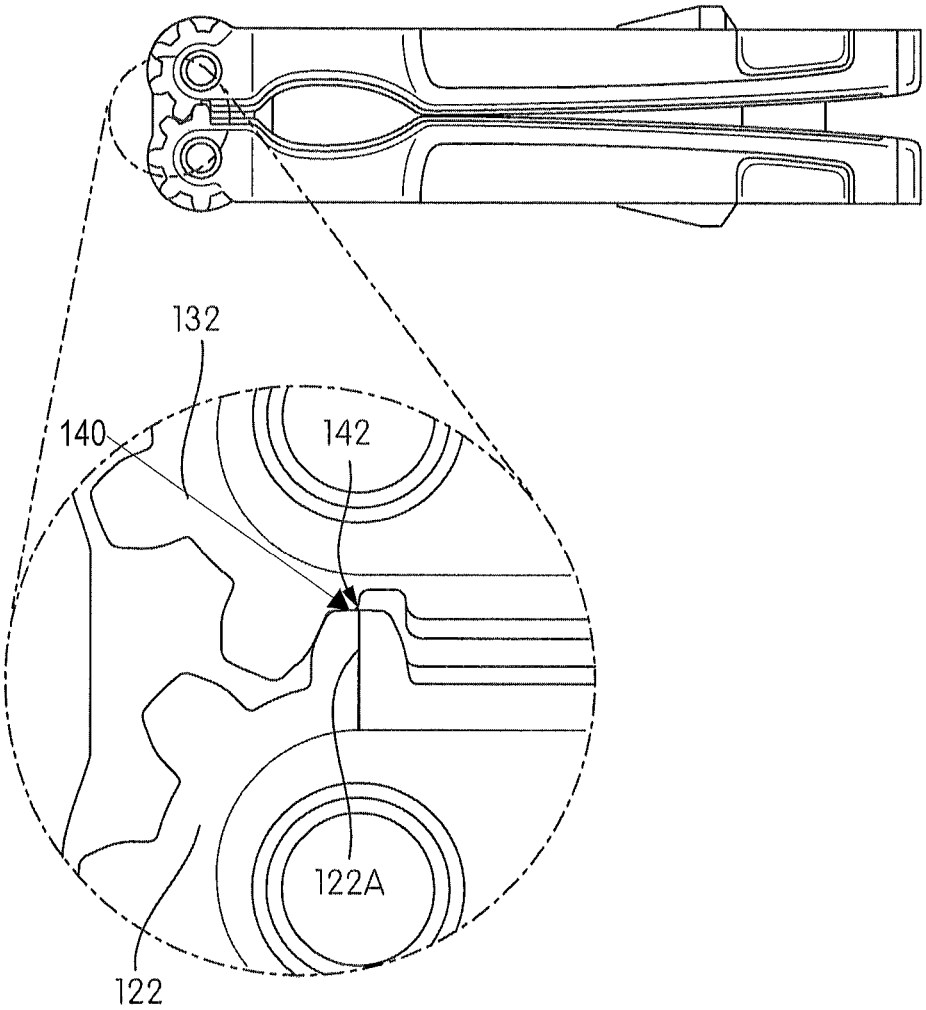
FIG. 3 shows a top view of the foldable chisel of FIG. 1A in the closed position.

The handles 120 and 130 have an over-center structure 140 that impedes rotation of the two handles away from the closed position. Thus, when handles 120 and 130 are folded to the closed position, the over-center structure inhibits the handles from being accidentally unfolded. The over-center structure 140 requires application of a predetermined force to enable the handles to overcome a force that tends to keep the handles closed. FIG. 3 shows one example of over-center structure, which in this embodiment takes the form of a detent 140 that is formed on a recessed portion of gear 132. Other types of over-center structures, such as that which may be used with a four-bar linkage and spring structure can also be used. The recessed portion receives a gear tooth 122A of gear 122 when handles 120 and 130 are at or near the closed position. The detent 140 may comprise a bulge 142 that protrudes from the recessed portion. As handles 120 and 130 are near the closed position, like that shown in FIG. 3, gear tooth 122A may engage the bulge 142 of detent 140, causing gear tooth 122A to be squeezed against the bulge 142. The force exerted by gear tooth 122A and bulge 142 against each other may impede rotation of the gears and require a user to overcome the detent 140 by applying a rotational force that is sufficient to squeeze gear tooth 122A and bulge 142 of the detent 140 past each other. The detent 140 impedes the rotation until bulge 142 of detent 140 passes over the center of gear tooth 122A. After passing over the over-center position, the handles 120, 130 are biased toward the closed position. Thus, when moving the handles 120, 130 from the open position to the closed position, the handles may snap into the closed position after passing the over-center position. When opening or unfolding the handles 120, 130, the handles can freely rotate toward the open position after passing the over-center position.

When handles 120 and 130 are rotated to the open position, interlocking features 126 and 136, as shown in FIG. 4, may releasably couple the two handles in the open position. FIG. 4 shows an embodiment in which handles 120 and 130 are identical. The Figure shows the two handles unassembled from blade 110, showing the back side of both handles. To assemble the handles to blade 110, one handle is rotated 180 degrees relative to the other. When handles 120 and 130 are coupled to blade 110 and are in the open position, the back sides of the two handles face each other and interlocking features 126 and 136 may snap together. Each of interlocking features 126 and 136 may comprise a protruding portion and a recessed portion. For example, interlocking feature 126 may have a protruding portion 126A that is received by a recessed portion 136B, and may have a recessed portion 126B that receives protruding portion 136A.

Figures 5A, 5B, 5C:
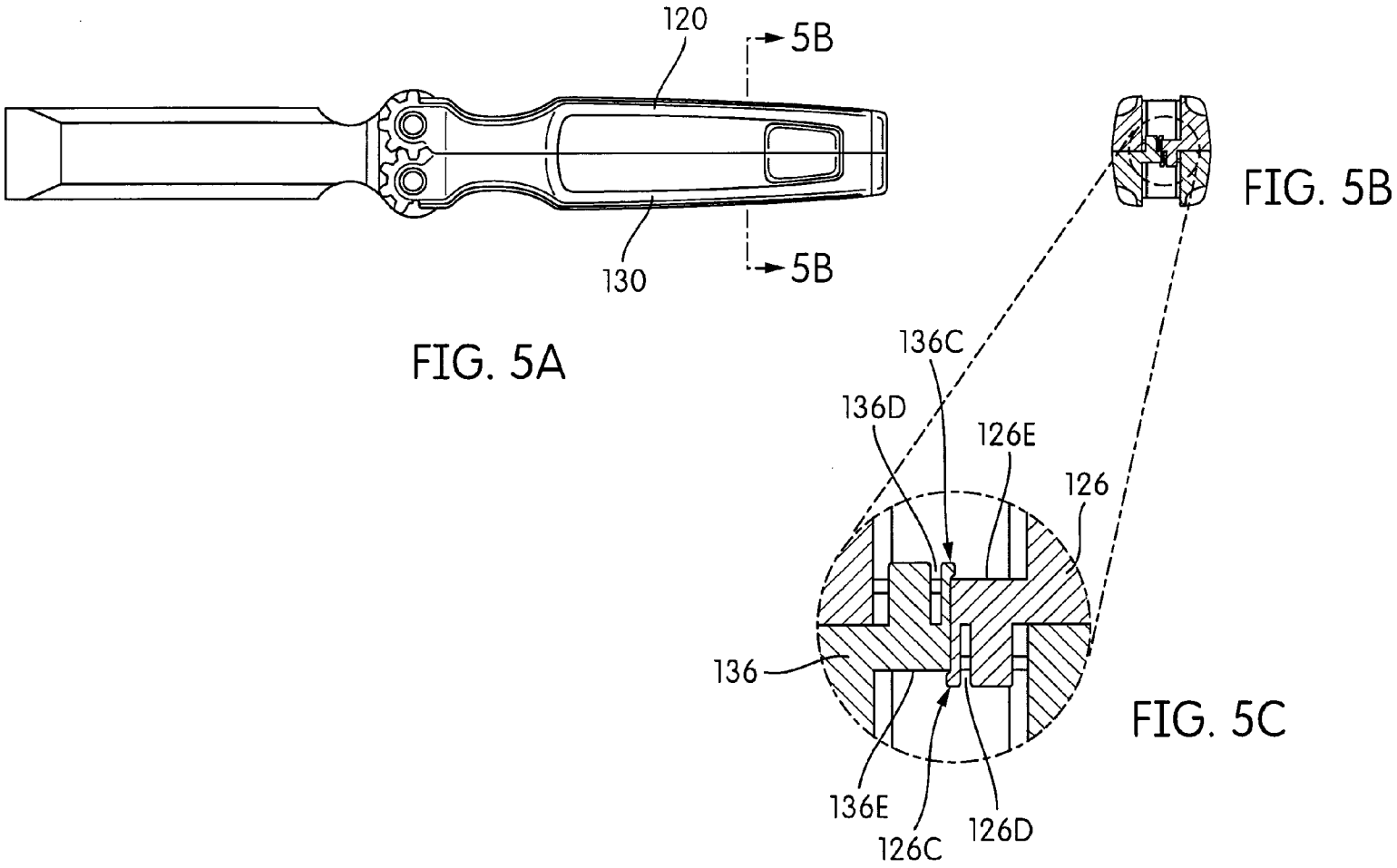
FIG. 5A shows a top view of the foldable chisel of FIG. 1A in the open position.
FIG. 5B shows a cross section view taken along line 5B-5B in FIG. 5A (looking away from the blade).
FIG. 5C shows an expanded view of the cross section view shown in FIG. 5B.

More detail of the interlocking features 126 and 136 is provided in FIGS. 5A-5C, which show a top view and a cross sectional view of chisel 100 in the open position. FIG. 5B shows releasable coupling of the two handles in FIG. 5A from the perspective of line 5B-5B in FIG. 5A. Each interlocking feature 126, 136 may comprise a resilient finger 126C and 136C, respectively, with a bulge formed on the end thereof. The finger 126C or 136C of each of interlocking features 126 and 136 may be sufficiently resilient to be capable of being deflected away from the other interlocking feature, towards a recessed portion 126D or 136D, respectively, behind the finger 126C or 136C.

As handles 120 and 130 are rotated to the open position and interlocking features 126 and 136 engage each other, the bulge portion of each finger 126C and 136C may slide against the other interlocking feature. After the bulge portion of finger 126C slides past end surface 136E, it snaps into a position that opposes reverse motion of finger 126C relative to the other interlocking feature 136. After the bulge portion of finger 136C slides past end surface 126E, it snaps into a position that opposes reverse motion of finger 136C relative to the other interlocking feature 126. When interlocking features 126 and 136 are snapped together, the bulges of finger 126C and 136C tend to keep handles 120 and 130 in the open, unfolded position.

When handles 120 and 130 are pulled from the open position to rotate them toward the closed position, a sufficient pulling force may deflect the fingers 126C and 136C of interlocking features 126 and 136, respectively, so that they release the coupling between the two handles 120 and 130. For example, as shown in FIGS. 5B and 5C, handle 120 may be pulled in an upward direction and handle 130 may be pulled in a downward direction to rotate them toward the closed position. The pulling force may be transferred to interlocking features 126 and 136. The force may deflect the resilient finger 126C towards the recessed portion 126D behind the finger 126C, and may deflect the resilient finger 136C towards the recessed portion 136D behind the finger 136C. Deflecting finger 126C and 136C toward recess 126D and 136D, respectively, moves the bulge of each finger away from their snapped positions. A sufficient deflection of finger 126C and 136C and of their bulges may allow the two fingers to slide past each other toward the closed position. The bulge of finger 126C, for example, may be sufficiently deflected to allow finger 126C to slide upwards, away from end surface 136E, while the bulge of finger 136C may be sufficiently deflected to allow finger 136C to slide downwards, away from end surface 126E.

In some embodiments, handles 120 and 130 may not be identical. For example, only one of fingers 126C and 136C may have a bulge formed on the end thereof, or the two fingers 126C and 136C may each have a bulge formed thereon that has a different shape from the bulge of the other finger.

Although embodiments in the figures show a chisel blade, other embodiments of the invention may include a gouge blade, a file blade, a knife blade, or any other type of blade.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A foldable chisel comprising:

a blade;

a first handle rotatably coupled to the blade and forming a first channel adapted to receive a first side of the blade;

a second handle rotatably coupled to the blade and forming a second channel adapted to receive a second side of the blade opposite the first side of the blade, the first handle and second handle rotatable between an open position in which the blade is substantially exposed and a closed position in which the blade is at least partially contained in the first channel and the second channel, wherein the first handle and the second handle comprise a rotatable coupling such that the first handle and the second handle rotate with one another in opposite directions between the closed position and the open position, and wherein the rotatable coupling further comprises an over-center structure configured to impede rotation of the first handle and the second handle from the closed position toward the open position until the over-center structure rotates past an over-center position, wherein application of a threshold force on the first handle and the second handle enables the first handle and the second handle to overcome a force, provided by the over-center structure, that impedes rotation of the first handle and the second handle, and wherein the first handle and the second handle are biased toward the closed position when rotating the first handle and the second handle from the open position to the closed position and when the over-center structure rotates past the over-center position.

2. The foldable chisel of claim 1, wherein the rotatable coupling comprises a first gear on the first handle and a second gear on the second handle, the first gear having one or more gear teeth operatively engaged with one or more gear teeth of the second gear.

3. The foldable chisel of claim 1, wherein the over-center structure comprises a detent formed on at least one of the first gear or the second gear.

4. The foldable chisel of claim 3, wherein the one or more gear teeth of the first gear are meshed with the one or more gear teeth of the second gear to substantially synchronize rotation of the first handle and second handle.

5. The foldable chisel of claim 4, wherein the detent comprises a bulge portion provided on a recessed portion of one of the first gear and the second gear, the bulge portion adapted to engage one of the gear teeth of the other of the first gear and the second gear when the first handle and the second handle are near the closed position, the engagement between the bulge portion and the one of the gear teeth impeding rotation of the first gear or second gear.

6. The foldable chisel of claim 5, wherein the application of the threshold force on the first handle and the second handle enables the first handle and the second handle to snap into the closed position when the bulge portion rotates past a center of the one of the gear teeth toward the closed position.

7. The foldable chisel of claim 1, wherein the first handle and second handle each comprise an interlocking component, the two interlocking components adapted to releasably couple the first handle and the second handle when the two handles are rotated to the open position.

8. The foldable chisel of claim 7, wherein the two interlocking components of the first handle and the second handle are constructed and arranged to engage each other when the two handles are rotated to the open position, and wherein engagement of a portion of one of the two interlocking components with a portion of the other of the two interlocking components enables the two interlocking components to snap together in the open position.

9. The foldable chisel of claim 7, wherein the first handle and the second handle each have a back side, the two back sides being adjacent to each other when the first handle and the second handle are rotated to the open position, and wherein each of the two interlocking components is formed on the back side of its respective handle.

10. The foldable chisel of claim 7, wherein a shape of one of the two interlocking components is a shape of the other of the two interlocking components rotated by 180°.

11. A foldable chisel comprising:

a blade;

a first handle rotatably coupled to the blade, the first handle comprising a first interlocking component and forming a first channel adapted to receive a first side of the blade;

a second handle rotatably coupled to the blade, the second handle comprising a second interlocking component and forming a second channel adapted to receive a second side of the blade opposite the first side of the blade, the first handle and the second handle rotatable between an open position in which the blade is substantially exposed and a closed position in which the blade is at least partially contained in the first channel and the second channel, wherein the first handle and the second handle comprise a rotatable coupling having a first gear on the first handle and a second gear on the second handle, wherein the first gear and the second gear are constructed and arranged to substantially synchronize rotation of the first handle and second handle between the open position and the closed position such that the first handle and the second handle rotate in opposite directions at substantially the same rate, wherein the first interlocking component and the second interlocking component are adapted to releasably couple the first handle and the second handle when the two handles are rotated at substantially the same rate to the open position, wherein the rotatable coupling includes an over-center structure configured to impede rotation of the first handle and the second handle from the closed position toward the open position until the over-center structure rotates past an over-center position, wherein application of a threshold force on the first handle and the second handle enables the first handle and the second handle to overcome a force, provided by the over-center structure, that impedes rotation of the first handle and the second handle, and wherein the first handle and the second handle rotate toward the open position when the over-center structure rotates past the over-center position.

12. The foldable chisel of claim 11, wherein the two interlocking components are constructed and arranged to engage each other when the first handle and second handle are rotated to the open position, and wherein engagement of a portion of one of the two interlocking components with a portion of the other of the two interlocking components enables the two interlocking components to snap together in the open position.

13. The foldable chisel of claim 12, wherein at least one of the the portion of one of the interlocking components comprises a bulge portion adapted to engage the portion of the other of the two interlocking components when the two interlocking components are snapped together in the open position and to impede rotation of the two interlocking components from the open position toward the closed position.

14. The foldable chisel of claim 11, wherein, when the first handle and the second handle are pulled from the open position to rotate them toward the closed position, application of a pulling force on the two interlocking components enables at least one of the two interlocking components to deflect away from the other of the two interlocking components so as to release the releasable coupling between the two handles.

15. The foldable chisel of claim 11, wherein a shape of the first interlocking component is a shape of the second interlocking component rotated by 180°.

16. The foldable chisel of claim 11, wherein the first handle and the second handle each have a back side, the two back sides being adjacent to each other when the first handle and the second handle are rotated to the open position, and wherein the first interlocking component and the second interlocking component are formed on the back side of its respective handle.

17. The foldable chisel of claim 16, wherein the back side of each handle forms a recess adapted to at least partially receive the interlocking component of the other handle when the two handles are in the open position.

18. The foldable chisel of claim 17, wherein the recess of the first handle is part of the first channel and the recess of the second handle is part of the second channel.

19. The foldable chisel of claim 11, wherein the first gear having one or more gear teeth operatively engaged with one or more gear teeth of the second gear, and wherein the over-center structure comprises a detent formed on at least one of the first gear or the second gear.

* * * * *